United States Patent [19]

Trammell

[11] 4,404,988

[45] Sep. 20, 1983

[54] PRESSURE SEATED CLOSURE FOR CONTAINMENT DRAIN

[75] Inventor: Joel H. Trammell, Hinsdale, Ill.

[73] Assignee: Chicago Bridge & Iron Company, Oak Brook, Ill.

[21] Appl. No.: 331,213

[22] Filed: Dec. 16, 1981

[51] Int. Cl.[3] ..... E03B 5/00

[52] U.S. Cl. ..... 137/565; 137/67; 137/312; 251/12; 251/297

[58] Field of Search ..... 137/312, 67, 68, 467, 137/565; 251/12, 297

[56] References Cited

U.S. PATENT DOCUMENTS

| | | | |
|---|---|---|---|
| 1,972,496 | 9/1934 | Schlimbach | 137/565 |
| 3,782,411 | 1/1974 | Turner | 137/467 |
| 3,889,707 | 6/1975 | Fay | 137/312 X |

*Primary Examiner*—Harold W. Weakley

*Attorney, Agent, or Firm*—Merriam, Marshall & Bicknell

[57] ABSTRACT

Apparatus for draining a liquid which has been inadvertently freed from a primary storage container and captured in a containment space comprising a drain conduit extending from the containment space to a remote location, with said drain conduit having an opening in a lower part of the containment space into which captured liquid can flow by gravity when not closed; a valve, in the drain conduit, outside of the containment space; a pressurization line, containing a valve, communicating with the drain conduit between the drain conduit valve and the conduit opening; a closure in the drain conduit opening adapted to bar flow of captured liquid into the drain conduit; and a closure retainer releasably securing the closure in the drain conduit opening; whereby when it is desired to remove captured liquid from the containment space the pressurization line valve can be opened and fluid under pressure can be fed to the pressurization line to deliver it to the drain conduit with the drain conduit valve closed so that the resulting pressure against the inside surface of the closure forces it out of the opening following which the pressurization line valve can be closed and the drain conduit valve opened to remove captured liquid from the containment space.

6 Claims, 3 Drawing Figures

10
12
16
18
22
24
26
28
30
32
34
36
40
42
44
46
48
50
60
62
64
66
68
70

PRESSURE SEATED CLOSURE FOR CONTAINMENT DRAIN

This invention relates to liquid drain conduits or pipes and closures for drain openings therein. More particularly, this invention is concerned with an improvement in drain opening closures so that the closure can be remotely removed to drain off captured liquid, which escaped from storage, having potentially dangerous physical or chemical properties.

BACKGROUND OF THE INVENTION

Many different liquids, including liquefied gases such as LPG and LNG, are stored in tanks of various types. The chemical and physical properties of a number of such liquids makes them hazardous, especially those which are highly flammable. Because of the inherent danger which many liquids pose if they leak or escape from a primary storage tank or vessel, especially in relatively populated areas, it has been required to surround the tank or vessel with an outwardly positioned containment wall or barrier of sufficient size and quality so as to encompass a space or volume adequate to capture and hold most or all of the liquid content which the storage tank is capable of storing. Since there may be no or little warning if the storage tank fails, it is generally considered desirable for all escaping liquid to be captured initially by the containment wall and held in a containment space until an appropriate decision can be made as to the disposition of the liquid. If it is decided to remove the liquid for restorage or disposal a means for draining the liquid from the containment is needed. However, any drain pipe or conduit should generally be remotely operable because of the properties of many of the liquids and it should not permit the liquid to enter it until the liquid is to be drained from the containment space.

SUMMARY OF THE INVENTION

According to the invention there is provided a novel improved drain conduit apparatus which extends from a containment space, in which escaped liquid can be captured, to a remote location. The conduit drain system is especially useful for draining an inflammable liquid which is inadvertently freed from a primary storage container and captured in a surrounding containment space.

The drain conduit or pipe has an opening in a lower part of the containment space into which captured liquid can flow by gravity when not closed. A valve is positioned in the drain conduit outside of the containment space.

A pressurization line, containing a valve, communicates with the drain conduit between the drain conduit valve and the conduit opening.

A closure is positioned in the drain conduit opening and is adapted to bar flow of captured liquid into the drain conduit. The closure is releasably and removably secured in place in the conduit opening by a closure retainer means.

When it is desired to remove captured liquid from the containment space the pressurization line valve is opened and fluid under pressure is fed to the pressurization line which delivers it to the drain conduit, with the drain conduit valve closed, so that the resulting fluid pressure against the inside surface of the closure forces it out of the opening. Then the pressurization line valve is closed and the drain conduit valve is opened to remove captured liquid from the containment space.

A pump can be included, in the drain conduit, exterior of the containment space to aid in draining off the liquid.

To facilitate forming a liquid tight seal, the closure desirably includes a resilient gasket which presses against the drain conduit.

The closure can be maintained in sealing position to close the drain conduit opening by any suitable means which will yield or be displaced when an appropriate fluid pressure is applied to the inside of the closure so that the closure will be moved out of the way and liquid access to the opening developed in that way.

DETAILED DESCRIPTION OF THE DRAWINGS

To the extent it is reasonable and practical, the same numbers will be used to identify the same or similar elements in the various views of the drawings.

Figure 1:
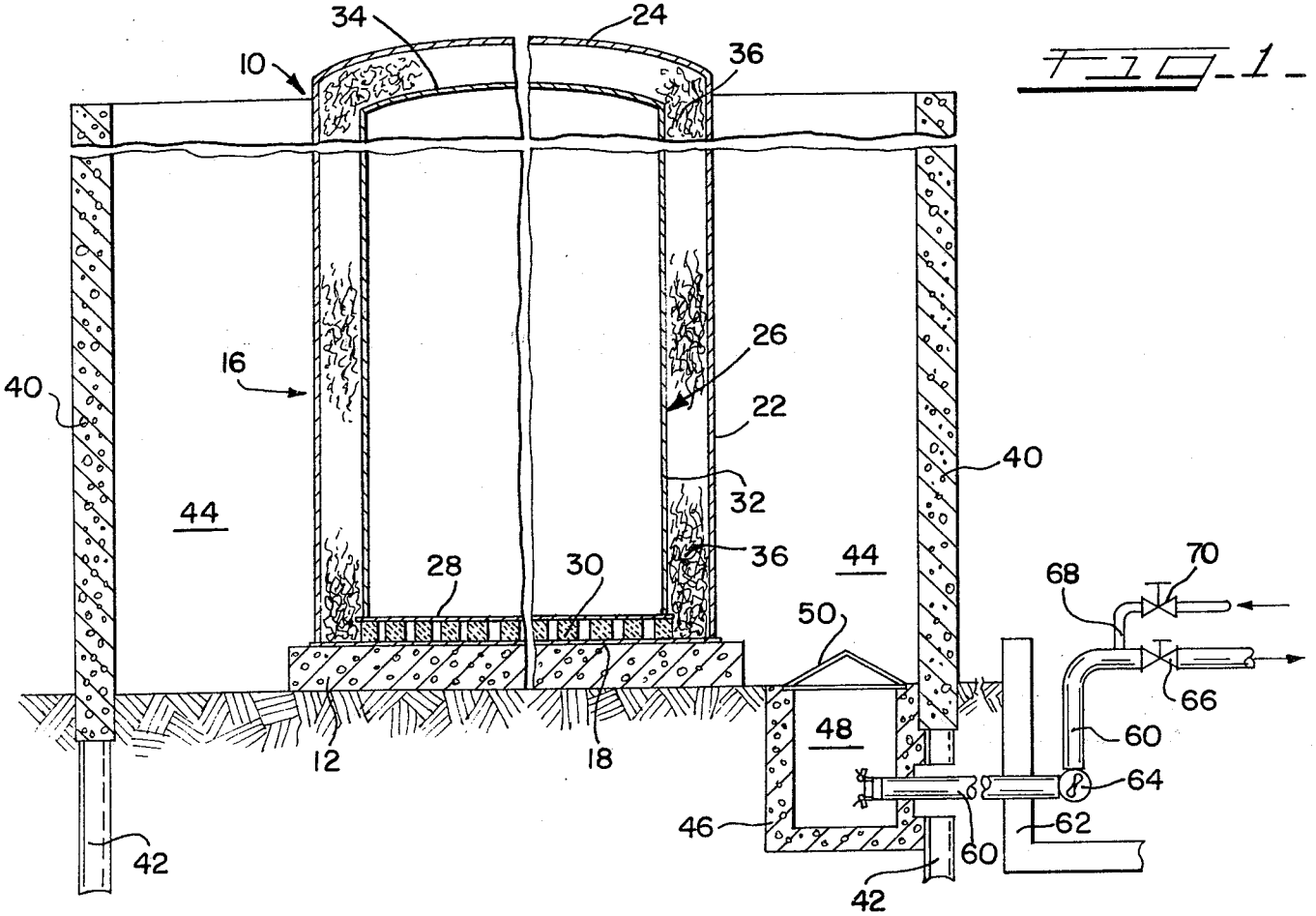
FIG. 1 is a vertical sectional view through a typical insulated double wall primary storage tank with a surrounding liquid containment wall and a drain conduit system according to the invention.
Figure 3:
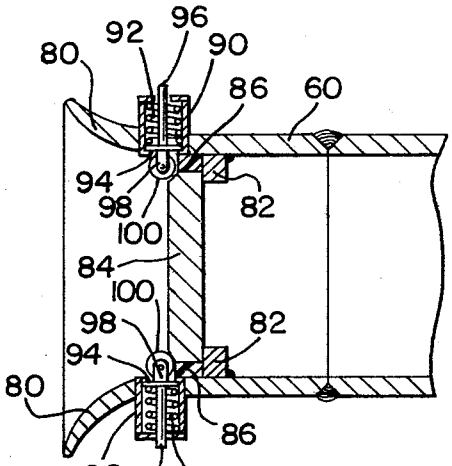
FIG. 3 is an enlarged view of the closure in the opening of the drain conduit system shown in FIGS. 1 and 2.
Figure 2:
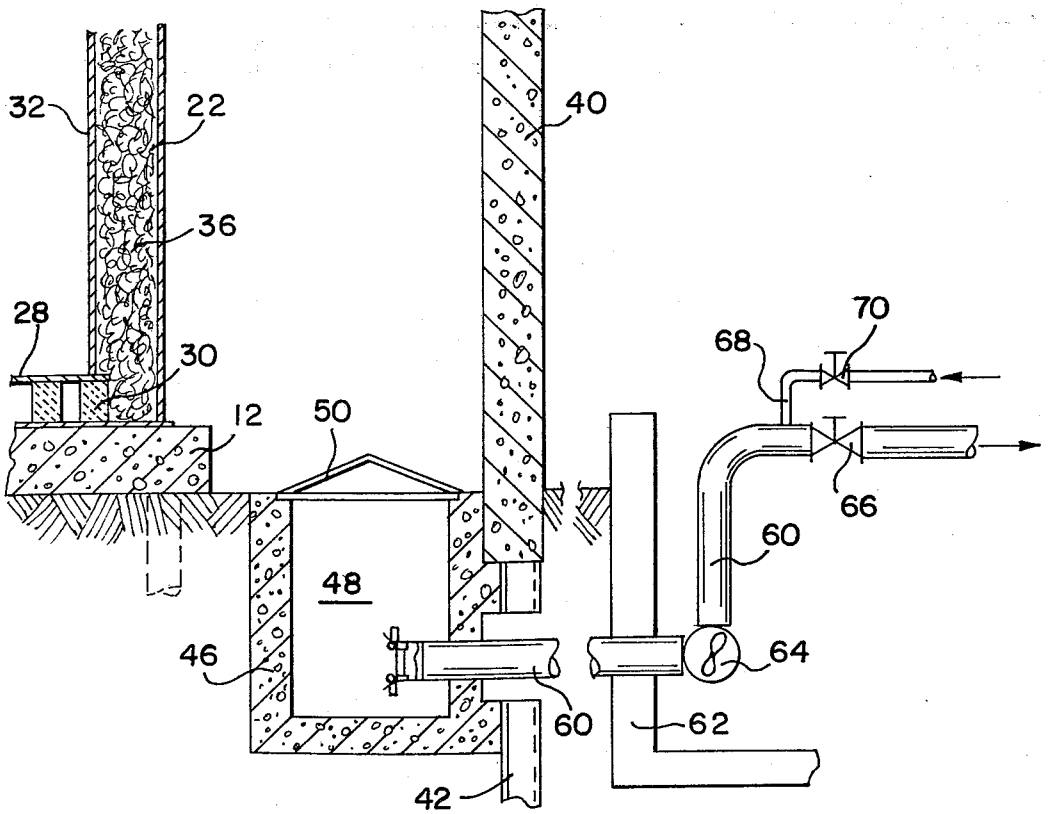
FIG. 2 is an enlarged view of the drain conduit system shown in FIG. 1.

With reference to FIGS. 1 and 2, the primary liquid storage tank 10 rests on foundation 12 supported by the earth 14. The tank 10 has an outer metal shell 16 comprising a flat circular metal bottom 18 which rests on foundation 12, a vertical circular cylindrical metal wall 22 and a domed roof 24. Tank 10 also has an inner metal shell 26 spaced inwardly from the outer metal shell 16. The flat circular metal bottom 28 of the inner shell 26 rests on insulating blocks 30. Circular cylindrical metal wall 32 extends upwardly from bottom 28 and supports domed inner roof 34. Insulating material 36 is positioned in the space between the inner wall 32 and the outer wall 22, and between the inner roof 34 and the outer roof 24.

A tank 10 of the described type is useful for storing flammable liquefied gases, such as liquefied petroleum gas (LPG) and liquefied methane (LNG). Various inlet and outlet pipes for feeding liquid to, and removing it from, the storage tank 10 would be included but are not shown since they do not relate to the invention.

Surrounding tank 10 is a vertical circular cylindrical concrete containment wall 40, supported on piles 42, defining a liquid confinement space 44. A drain vault 46 of concrete is positioned in the earth 14 below the bottom surface of confinement space 44 so that liquid can flow from space 44 to the vault space 48. Vault 46 is open at the top but is protected by a heavy grating 50.

Drain conduit 60 extends through the wall of vault 46, through piling 42 and through a retaining wall 62. Drain conduit 60 ends in the vault space 48 near the bottom. Pump 64 is mounted in drain conduit 60, as is valve 66. Pressurization line 68, containing valve 70, communicates with drain conduit 60 upstream of valve 66. Line 68 can be used to convey either a pressurized liquid or gas.

The end 80 of drain conduit 60 in vault space 48 flares outwardly. Inside of conduit 60, adjacent the flared end 80, is positioned a metal ring 82 which is welded to the conduit. Closure 84 in the form of a flat metal circular plate with a resilient gasket 86 is positioned in the open end of the conduit 60 with the peripheral edge portion of plate 84 abutting ring 82.

A plurality of guides 90 are positioned around the end of conduit 60. Each guide 90 contains a spring 92 which acts on a piston plate 94 mounted on the end of rod 96. A pair of spaced apart flanges 98 extend outwardly from piston plate 94 and support an axle on which cam wheel 100 is mounted. Cam wheel 100 presses against the beveled edge of closure plate 84 and thus releasably and removably holds it in place to seal the conduit opening against flow of liquid.

In the event liquid escapes from tank 10 and is captured in space 44 from which it can flow into vault space 48, the liquid can be drained off, once a decision has been made to do so, by closing valve 66 and opening pressurization line valve 70. Fluid under pressure is then supplied to pressurization line 68 which feeds it to conduit 60 to apply pressure to the inside surface of closure 84. The pressure forces the closure 84 to blow out of the opening in conduit 60 thereby permitting liquid to flow into the conduit. Gas valve 70 is then closed and drain conduit valve 66 is opened. Pump 64 is then activated to aid in liquid removal and delivery of it to a remote location. Because of its structure, however, the pump 64 does not adversely interfere with the flow of gas from gas line 68 to the inside surface of closure 84.

The closure system of this invention may be considered as semi-destructive in that the closure plate 84 is blown out of the conduit opening and must be replaced manually to reclose the opening.

The foregoing detailed description has been given for clearness of understanding only, and no unnecessary limitations should be understood therefrom as modifications will be obvious to those skilled in the art.

What is claimed is:

1. Apparatus for draining a liquid which has been inadvertently freed from a primary storage container and captured in a containment space comprising:

a drain conduit extending from the containment space to a remote location, with said drain conduit having an opening in a lower part of the containment space into which captured liquid can flow by gravity when not closed;

a valve, in the drain conduit, outside of the containment space;

a pressurization line, containing a valve, communicating with the drain conduit between the drain conduit valve and the conduit opening;

a closure in the drain conduit opening adapted to bar flow of captured liquid into the drain conduit; and closure retainer means releasably securing the closure in the drain conduit opening;

whereby when it is desired to remove captured liquid from the containment space the pressurization line valve can be opened and fluid under pressure can be fed to the pressurization line which delivers it to the drain conduit with the drain conduit valve closed so that the resulting pressure against the inside surface of the closure can force it out of the opening following which the pressurization line valve can be closed and the drain conduit valve opened to remove captured liquid from the containment space.

2. Apparatus according to claim 1 including a pump, in the drain conduit, exterior of the containment space.

3. Apparatus according to claim 1 or 2 in which the closure includes a gasket to form a liquid tight seal with the drain conduit.

4. Apparatus according to claim 1 or 2 in which spring means maintains the closure in sealing position in the drain conduit opening.

5. Apparatus according to claim 1 or 2 in which the pressurization line is adapted to convey a liquid.

6. Apparatus according to claim 1 or 2 in which the pressurization line is adapted to convey a gas.

* * * * *